US005722005A

United States Patent [19]

Kitajima

[11] Patent Number: 5,722,005

[45] Date of Patent: Feb. 24, 1998

[54] IMAGE FORMING APPARATUS WITH CONTROL OF CHARGING, EXPOSURE AND DEVELOPMENT ACCORDING TO IMAGE DENSITY STEPS

[75] Inventor: Tatsuya Kitajima, Kawasaki, Japan

[73] Assignee: Kabushiki Kaisha Toshiba, Kawasaki, Japan

[21] Appl. No.: 651,543

[22] Filed: May 22, 1996

[30] Foreign Application Priority Data

May 24, 1995 [JP] Japan ..... 7-125185

[51] Int. Cl.[6] ..... G03G 15/00

[52] U.S. Cl. ..... 399/46; 399/138

[58] Field of Search ..... 399/47, 138, 48, 399/55, 56, 50, 51

[56] References Cited

U.S. PATENT DOCUMENTS

| | | | |
|---|---|---|---|
| 4,256,401 | 3/1981 | Fujimura et al. | 399/138 |
| 4,350,435 | 9/1982 | Fiske et al. | 399/138 |
| 4,702,590 | 10/1987 | Usami | 399/47 |
| 4,990,953 | 2/1991 | Ibuchi | 355/69 |
| 5,146,269 | 9/1992 | Shimizu et al. | 399/8 |

FOREIGN PATENT DOCUMENTS

| | | |
|---|---|---|
| 3-14188 | 2/1991 | Japan . |
| 5-61303 | 3/1993 | Japan . |

*Primary Examiner*—Robert Beatty
*Attorney, Agent, or Firm*—Foley & Lardner

[57] ABSTRACT

An exposure step input circuit inputs a desired brightness of a printing image as one of a plurality of exposure steps and a lamp application voltage adjusting unit allows the application voltage of an exposure lamp to, on the bright side of the exposure steps, be increased with a smaller predetermined slope than a dark side each time the exposure step is switched in the bright direction. At this time, a shortage of an exposure is compensated for by lowering a surface potential on a photosensitive drum through the decreasing of a charge current by a charger or raising a developing bias voltage of a developing unit. An image forming apparatus thus provided can obtain a better image at all times by, even on the bright side of the exposure steps in the adjustment of an exposure amount, preventing a lowering in density of an image, deposition of carriers, and other disadvantages.

5 Claims, 8 Drawing Sheets

IMAGE FORMING APPARATUS WITH CONTROL OF CHARGING, EXPOSURE AND DEVELOPMENT ACCORDING TO IMAGE DENSITY STEPS

BACKGROUND OF THE INVENTION

1. Field of the Invention

The present invention relates to an image forming apparatus, such as an electronic copying apparatus, and, in particular, to an image forming apparatus for effecting high-speed printing.

2. Description of the Related Art

The recent tendency of an electronic copying apparatus of an electrophotographic system has been toward a high-speed version of the apparatus. With this tendency, there arises the problem with a deficiency in sensitivity specific to a photosensitive drum. This necessities rotating the photosensitive drum with higher and higher speeds on a resultant high-speed version of the electronic copying apparatus. This, in turn, needs a shorter and shorter time from a charging process to an exposure process of the photosensitive drum and then to a developing process. The shortage of a sensitivity level on the photosensitivity drum is liable to occur on the bright side (on the bright side on which the exposure lamp becomes bright) of an exposure step for adjusting an exposure amount (an image density).

As a measure for coping with the sensitivity shortage of the photosensitivity drum, the method has usually been used which, for example, brightens the amount of light of an exposure lamp such as a halogen lamp. Through the increasing of the brightness of the exposure lamp there occur various disadvantages, such as an increase in the load on the exposure lamp, a rise in the temperature of a document table situated in the neighborhood of the exposure lamp, an increase in the load on a power source, etc. In order to overcome such disadvantages and handle the sensitivity deficiency on the photosensitive drum the exposure amount is controlled, the detail of which will be explained below.

The reason why, usually, the increase in the light amount of the exposure lamp, the rise in the temperature of the document table and the increase of the load on the power source occur is because the most unfavorable condition arises on the bright side of the exposure step set by a control panel, etc., in particular, at a "bright max." level (the maximum level illuminated with the exposure lamp). Since, as set out above, the bright side of the exposure steps readily suffers from the above-mentioned problem, the known exposure control as will be set out below has usually been carried out. That is, with the application voltage of the exposure lamp fixed, the surface potential on the photosensitive drum is lowered by each exposure step from near the middle of the exposure steps toward the "bright max." level and, by doing so, a shortage of an exposure is replenished to obtain a bright image. Or with the application voltage of the exposure lamp fixed a developing bias voltage applied to a developing unit is raised by each exposure step from near the middle of the exposure steps toward the "bright max." level and, by doing so, a shortage of the exposure is replenished to obtain a bright image.

The conventional technique will be explained below with reference to FIGS. 1 to 5.

FIG. 1 shows a relation of the exposure step by the conventional control to an exposure lamp application voltage. Here the abscissa denotes the exposure steps (11 steps) and the ordinate denotes the voltage (exposure lamp application voltage) across the exposure lamp relative to the exposure steps. As evident from FIG. 1, when the exposure step is lowered (the exposure level is darkened), the exposure lamp application voltage is lowered, while, on the other hand, when the exposure step is raised (the exposure level is brightened), the exposure lamp application voltage is raised, so that a relation between the exposure step and the exposure lamp application voltage is substantially linear.

FIG. 2 shows a relation among a surface potential (dark potential: V0), a surface potential (halftone potential: Vh) and a developing bias voltage Vb when there exists a relation between the exposure steps and the exposure lamp application voltage as shown in FIG. 1, the former surface potential corresponding to the surface potential on the photosensitive drum relative to the exposure step and the latter surface potential corresponding to the surface potential on the photosensitive drum when it is exposed with a 51% half-tone. Here, the abscissa shows the exposure steps as shown in FIG. 1 and the ordinate is such that the first axis (left) corresponds to the surface potential (V0), 51% half tone potential (Vh) and developing bias voltage (Vb) and the second axis (right) corresponds to the exposure lamp application voltage.

Usually, when the exposure lamp application voltage is controlled, that is, varied with a given fixed slope from the bright side to the dark side (the darkening side of the exposure lamp), the surface potential (V0) remains unchanged by the exposure step and the bias voltage (Vb) also remains unchanged. Further, as the exposure lamp application voltage is raised from the dark side toward the bright side of the exposure step axis, the half tone voltage (Vh) is lowered with a nearly given slope. The control as shown in FIGS. 1 and 2 is the usual exposure amount control.

Given below is the method for controlling the bright side of the usual exposure step.

FIG. 3 shows the control by the exposure step on the bright side of the exposure step axis to effect brightening exposure control and shows a relation among the dark potential, 51% half tone potential (Vh), developing bias voltage (Vb) and exposure lamp application voltage relative to the exposure step axis. As shown in FIG. 3, the control by the normal exposure step of the bright side is effected by, with the exposure lamp application voltage fixed, lowering the surface potential on the photosensitive drum by the exposure steps on the brighter side than the middle of the exposure step axis to allow a resultant image to be brightened (or there is the case where the surface potential is sometimes lowered at the bright side maximum value, in FIG. 3, at the 11-th step only).

FIG. 4 shows the controlling of the developing bias voltage by the exposure step on the bright side of the exposure step axis to effect brightening exposure control and shows a relation among the dark area potential (V0), 51% half tone potential (Vh), developing voltage (Vb) and exposure lamp application voltage relative to the exposure step axis. As shown in FIG. 4, the control on the bright side of the normal exposure step is done as in the surface potential control in FIG. 3 by, with the exposure lamp application voltage fixed, raising the developing bias voltage by the exposure step on the brighter side than the middle of the exposure step axis to effect image brightening control (or there is sometimes the case where the developing bias voltage is raised at the bright side maximum value on the exposure step axis, in FIG. 11, on the 11-th step only).

It is to be noted that if, unlike the varying control of the surface potential (V0), the developing bias voltage is controlled, there occurs not variation in the 51% half tone potential at the exposure step at which the bias voltage varies (raised). That is because, by raising the developing bias voltage, a contrast voltage between the surface potential (V0) or 51% half tone potential (Vh) and the developing bias voltage is decreased so that the exposure amount is varied.

In the case where control is usually done on the bright side of the exposure step axis as set out above, there occur the drawbacks, such as a fall in density of an image, the deposition of carriers, and so on. FIG. 5 shows the lowering characteristic (broken lines) of the image density relative to the exposure steps in the case where the exposure control is made on the bright side of the exposure step axis through the lowering of the surface potential according to the exposure steps (the control method as shown in FIG. 3). Here, the abscissa denotes the exposure step axis and the ordinate the density of the image.

For comparison is shown the predictive value (solid lines) of the image density variation relative to the exposure step in the case where control is done on the prediction that the exposure lamp application voltage can be raised by the normal exposure step (control as shown in FIG. 1).

Here, as the electronic copying apparatus for obtaining the above-mentioned characteristic, use was made of Leodry model 6550 manufactured by Toshiba. Further, as the developing agent use was made of D-6550, as a toner, T-6550, and as a photosensitive drum, SD-6550 (selenium arsenide drum). By using these, an image was obtained in an ordinary temperature/ordinary humidity environment. Regarding the image density, for example, an image was printed with the use of an ID patch having a predetermined density (1.0) and the image density was measured by the Macbeth densitometer.

As evident from FIG. 5, it is predicted that, for the usual exposure step control, the image density is above 1.2 even at the bright max. (11-th step) level but that, as such, only 0.6 was obtained at the bright side control of the normal exposure step (the surface potential was controlled). Further, it has been confirmed that, even for the bright side control of the normal exposure step, the same result was obtained in the case where the developing bias voltage is varied.

In order to brighten the printing image for the bright side control of the usual exposure step the method has been used, such as the lowering of the surface potential on the photosensitive drum or the raising of the developing bias voltage. Regarding the control for lowering the surface potential on the photosensitive drum on the bright side of the exposure step axis for example, the image density is also lowered on the bright side of the exposure step as the surface potential on the photosensitive drum is lowered. At the bright max. level of the exposure step, in particular, the surface of the photosensitive drum become lowest, thus failing to obtain a requisite image density.

Further, regarding the control of raising the developing bias voltage on the bright side of the exposure step axis, an increase in the developing bias voltage results in a decrease in the density of the image and, further, carriers are liable to be deposited on the photosensitive drum and on the image. In particular, the developing bias voltage becomes highest at the bright max. level of the exposure step, thus failing to obtain a requisite image density. This also causes carriers to be liable to be deposited on the surface involved.

SUMMARY OF THE INVENTION

It is accordingly the object of the present invention to provide an image forming apparatus which, even on the bright side of the exposure step in the adjustment of exposure light, can prevent a lowering in the density of an image, deposition of carriers, and so on, and obtain a better image at all times.

In order to achieve the object of the above object, according to the first aspect of the present invention, there is provided an image forming apparatus comprising: means for exposing an original with light, the exposing means changes an amount of light according to a voltage supplied to the exposing means; means for forming an image of the original exposed by the exposing means on the surface of a photosensitive body; means for setting an image density of the image formed by the forming means, the setting means having a plurality of steps of image density ad the setting means selects one of the steps of the image density; first control means for reducing an amount of the voltage supplied to the exposing means by a first amount at each step of the image density, in case when the step of the image density selected by the setting means is darker than a predetermined step of the image density; and second control means for increasing the amount of the voltage supplied to the exposing means by a second amount smaller than the first amount at each step of the image density, in case when the steps of the image density selected by the setting means is brighter than the predetermined step of the image density.

According to the second aspect of the invention, there is provided an image forming apparatus comprising: means for charging a surface of a photosensitive body, the charging means changes an amount of charge according to a voltage supplied to the charging means; means for exposing an original with light, the exposing means changes an amount of light according to a voltage supplied to the exposing means; means for forming an image of the original on the surface of the photosensitive body charged by the charging means; means for setting an image density of the image formed by the forming means, the setting means having a plurality of steps of image density and the setting means selects one of the steps of the image density; first control means for reducing an amount of the voltage supplied to the exposing means by a first amount at each step of the image density and keeping an amount of the voltage supplied to the charging means at a constant value, in case when the step of the image density selected by the setting means is darker than a predetermined step of the image density; and second control means for increasing the amount of the voltage supplied to the exposing means by a second amount smaller than the first amount at each step of the image density and reducing the amount of the voltage supplied to the charging means smaller than the constant value, in case when the steps of the image density selected by the setting means is brighter than the predetermined step of the image density.

According to the third aspect of the invention, there is provided an image forming apparatus comprising: means for exposing an original with light, the exposing means changes an amount of light according to a voltage supplied to the exposing means; means for forming an optical image of the original on a surface of a photosensitive body; means for developing the optical image formed by the forming means by supplying a developing agent to the surface of the photosensitive body; means for supplying a developing bias voltage to the developing means; means for setting an image density of the image developed by the developing means, the setting means having a plurality of steps of image density and the setting means selects one of the steps of the image density; first control means for reducing an amount of the voltage supplied to the exposing means by a first amount at each step of the image density and keeping an amount of the developing bias voltage supplied by the supplying means at a constant value, in case when the step of the image density selected by the setting means is darker than a predetermined step of the image density; and second control means for increasing the amount of the voltage supplied to the exposing means by a second amount larger than the first amount at each step of the image density and increasing the amount of the developing bias voltage supplied by the supplying means smaller than the constant value, in case when the steps of the image density selected by the setting means is brighter than the predetermined step of the image density.

Even on the bright side of the exposure step in the adjustment of the exposure amount, the application voltage of the exposure lamp is varied with a small predetermined slope without conventionally setting it to be fixed. The shortage of the exposure is compensated for by making such control as to lower the surface potential or raise the developing bias voltage. By doing so it is possible to prevent a lowering in image density, the deposition of carriers on the photosensitive body, and so on, and obtain a better image at all times at any exposure step. It is also possible to prevent a rise in temperature of a document table and an increase in a load on a power source.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The embodiments of the present invention will be explained below with reference to the accompanying drawings.

Figure 6:
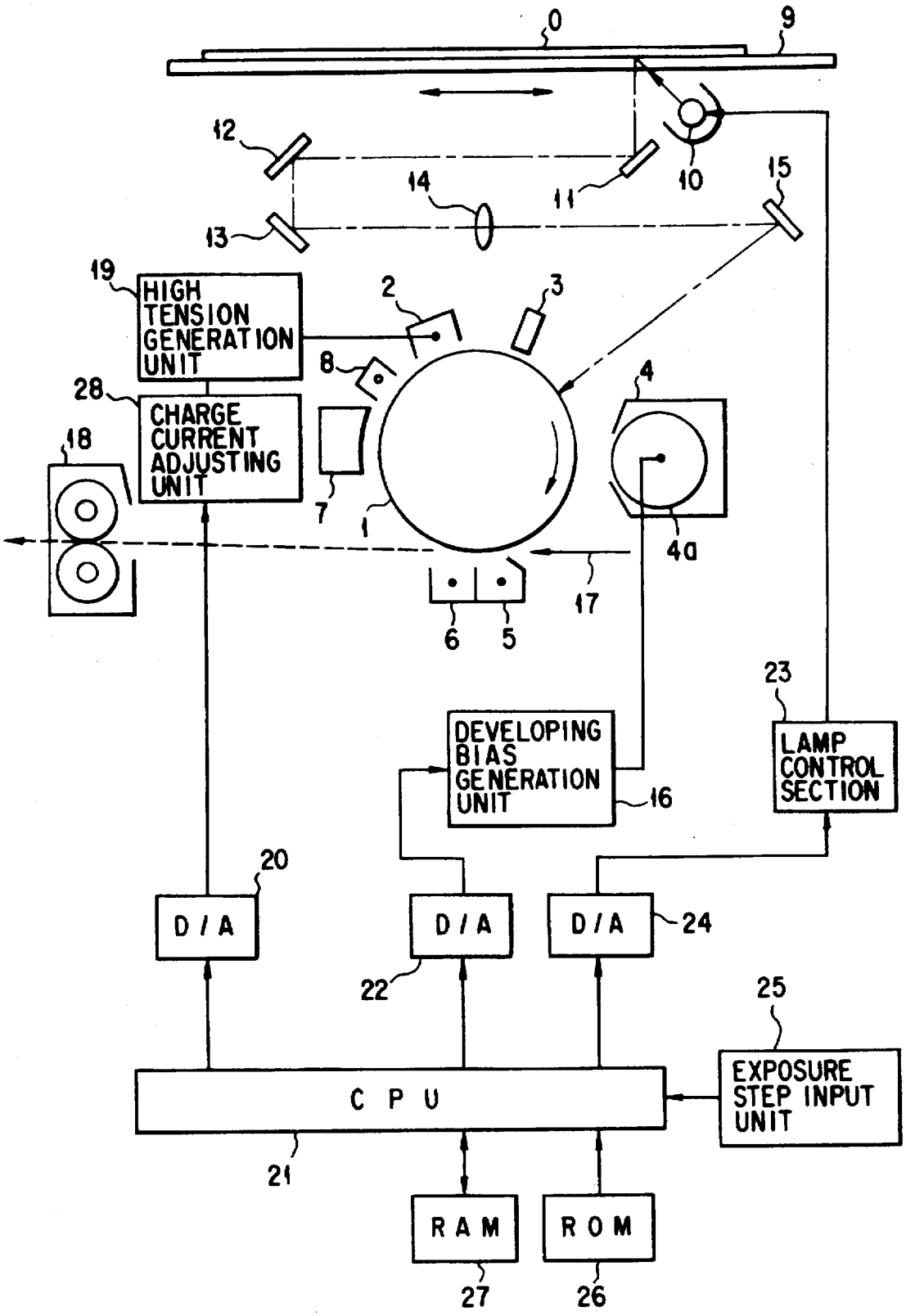
FIG. 6 is a diagrammatic view showing an arrangement of an electronic copying apparatus according to an embodiment of the present invention.

FIG. 6 is a diagrammatic view showing an arrangement of a positively charged photosensitive body/positively charged developing unit type electronic copying apparatus as one form of an image forming apparatus of the present embodiment.

As the photosensitive body a photosensitive drum 1 is composed of, for example, a selenium arsenide, an A—Si, and organic series photosensitive body, but according to the present invention use is made of the selenium arsenide photosensitive body. Around the photosensitive drum 1 along a rotation direction as indicated by an arrow in FIG. 6 are sequentially arranged a charger as a charging means, an LED lamp 3 for partial erasure, a developing unit 4 as a developing means, a transfer charger 5 as a transfer means, a separation charger 6, a cleaner 7 and a discharging lamp 8.

On the other hand, a document 0 on a fixed document table 9 is illuminated with an exposure lamp 10 movable back and forth in those directions as indicated by a double arrow in FIG. 6 and the reflected light is imaged on the charged photosensitive drum 1 via an optical system comprising a first mirror 11 movable together with the exposure lamp 10, second and third mirrors 12 and 13 and lens 14, fourth mirror 15, etc., so that an electrostatic latent image corresponding to the image of the document 0 is formed on the surface of the photosensitive drum 1.

The electrostatic latent image from the photosensitive drum 1 is toner-deposited by a developing roller **4*a* of the developing unit 4 supplied with a predetermined developing bias voltage from a developing bias generation section 16 so that it is deposited with the toner. Therefore, the toner image on the photosensitive drum is transferred by a transfer charger 5 to a sheet fed along an arrow 17 (shown) from a sheet supply section not shown. The toner image-transferred sheet is separated by a separation charger 6 from the photosensitive drum 1. The separated sheet is conveyed by a conveying path, not shown, to a fixing unit 18** serving as a fixing means where it is passed through a pair of heating rollers to allow it to be thermally fixed. Thereafter, it is discharged.

The charger 2 is connected to an output terminal of a high tension unit 19 which, in turn, is connected to a CPU (control processing unit) 21 via a charging current adjusting unit 28 and D/A converter 20, the CPU serving to effect control as a whole. To the CPU 21 is connected via a D/A converter 22 the developing bias generation unit 16.

The exposure lamp 10 is connected to the outer terminal of a lamp control unit 23 which, in turn, is connected to the CPU 21 via a D/A converter 24. An exposure step input unit 25 is connected as an exposure amount adjusting means to the CPU 21. The exposure step input unit 25 is provided, for example, in a control panel, not shown, and adapted to have an exposure amount adjusted by an operator. The exposure step input unit 25 has, for example, 11 steps with the sixth step as a middle position. In this case, the dark (D) side corresponds to the middle position (sixth step) 6 toward the first step (minimal value) and the bright (L) side, the sixth step toward the eleventh step (maximal value). By the switching of the respective exposure step, corresponding numeral data is entered.

The CPU 21 controls the lamp control unit 23 via the D/A converter 24 on the basis of the numeral data entered from the exposure step input unit 25 so that the application voltage to the exposure lamp 10 is varied to allow the exposure amount to vary.

Further, the CPU 21 controls the output (that is, the charge current of the charging unit 2) of the high tension generation unit 19 via the D/A converter 20 on the basis of the numeral data entered from the exposure step input section 25 so that it controls the surface potential on the photosensitive drum 1. The CPU 21 controls the output of the developing bias generation unit 16 via the D/A converter 22, so that it controls the developing bias voltage applied to the developing roller 4*a* of the developing unit 4.

To the CPU 21 are connected a read only memory (ROM) 26 and a random access memory (RAM) 27. The ROM 26 stores a control program and also stores the application voltage data of the exposure lamp on the bright side of the exposure step axis in a way to correspond to the respective exposure steps. The RAM 27 is comprised of a memory for storing various kinds of data.

In the above-mentioned arrangement, a brief explanation will first be given below on controlling the surface potential on the photosensitive drum in conjunction with the controlling of the bright side of the exposure steps in accordance with the present invention.

Figure 3:
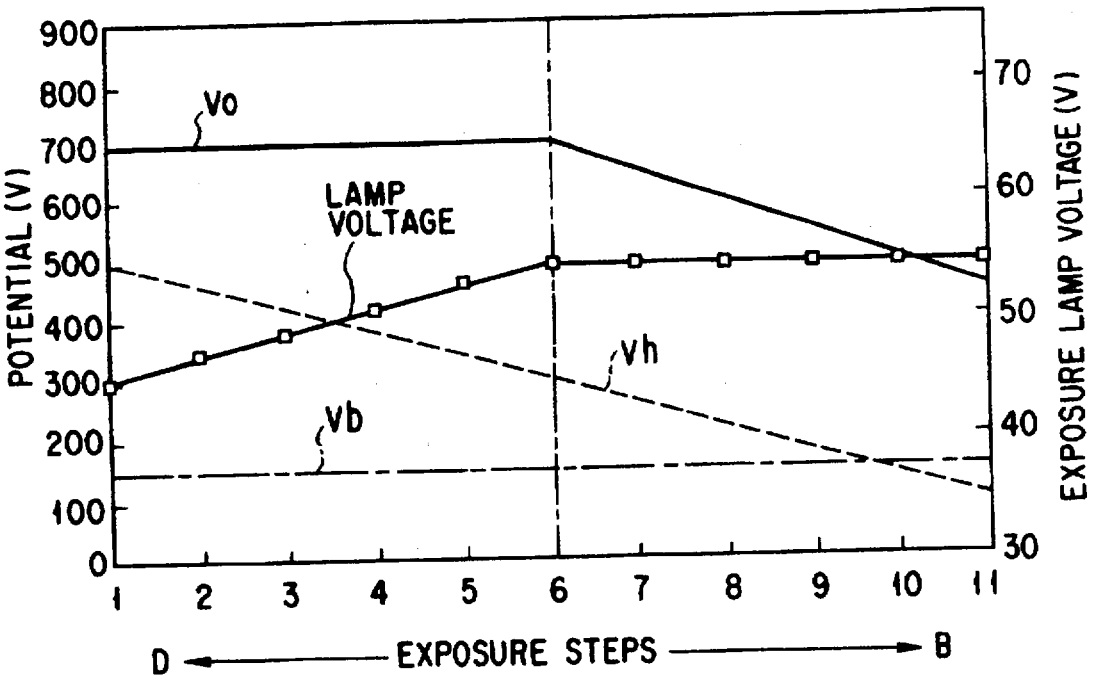
FIG. 3 PRIOR ART
FIG. 3 is a graph showing a relation among a surface potential, half tone potential, developing bias voltage and exposure lamp application voltage relative to an exposure step axis for explaining the conventional technique in the case where the surface potential on a photosensitive drum is controlled.
Figure 7:
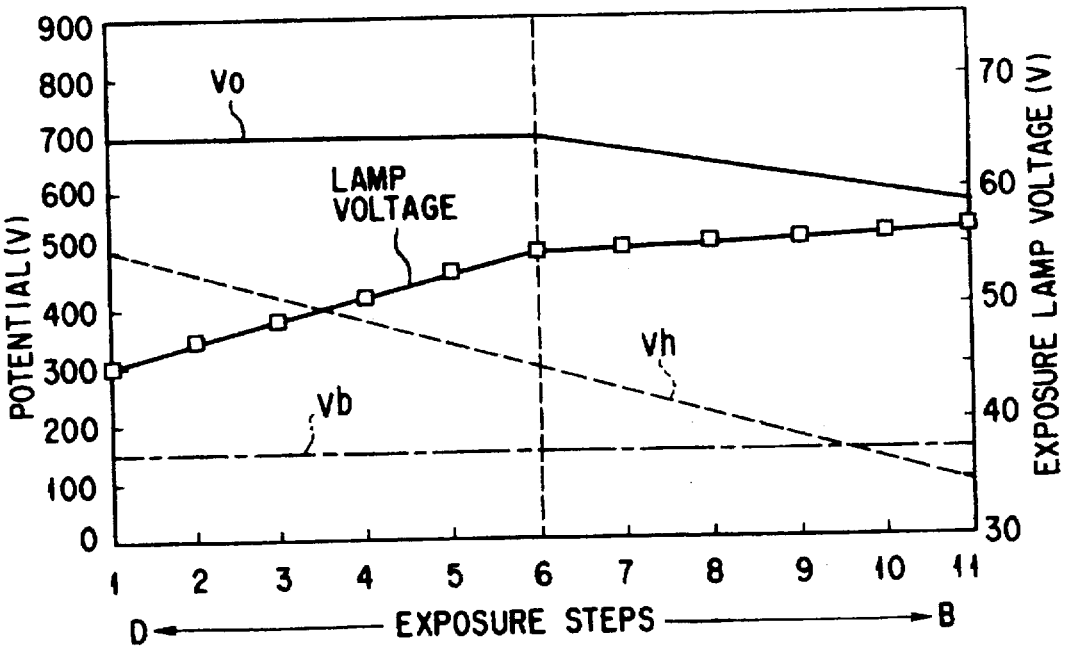
FIG. 7 is a graph showing a relation among a surface potential, half tone potential, developing bias voltage and exposure lamp application voltage relative to an exposure step axis in one embodiment of the present invention.

FIG. 7 shows the controlling of the surface potential on the photosensitive drum 1, on the bright side of the exposure step, in accordance with the exposure step to brighten the exposure level and shows a relation among the exposure step, the dark potential (V0) 5% half tone potential (Vh), the developing bias voltage and the lamp application voltage. Here, the abscissa shows the exposure steps (11 steps) of the exposure step input unit 25 and the second axis (right) of the coordinates, the exposure lamp application voltage. As shown in FIG. 7, in comparison with the bright side control (the control in FIG. 3) of the ordinary exposure steps, the exposure lamp application voltage is varied with a given slope, without being fixed from the middle of the exposure steps, and the surface potential control amount of the photosensitive drum 1 is suppressed to a less extent in accordance with a variation amount of the exposure lamp application voltage, noting that, in the example of FIG. 7, the exposure lamp application voltage is varied by 2V from the sixth step corresponding to the middle position of the exposure step axis to the eleventh step.

Figure 8:
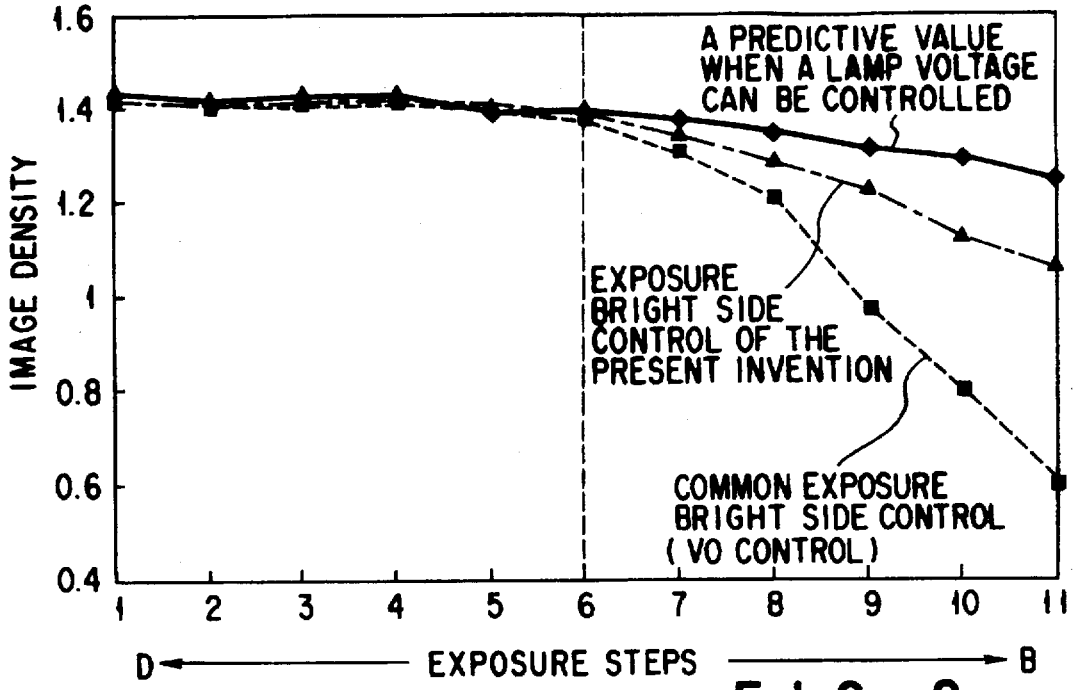
FIG. 8 is a graph showing a relation of an image density to an exposure step axis.

FIG. 8 shows a result of study on the effect of the control on the bright side of the above-mentioned exposure steps. Here, as the electronic copying apparatus under study, the Leodry Model 6550 was used, noting that it has been manufactured by Toshiba. Further, using SD-6550 as a developing agent, T-6550 as a toner and SD-6550 (selenium arsenide drum) as the photosensitive drum, an image was taken in the ordinary temperature/ordinary humidity environment for comparison study. Here, the abscissa denotes the exposure steps (11 steps) of the exposure step input unit 25 and the ordinate, the density of the printed image.

Figure 1:
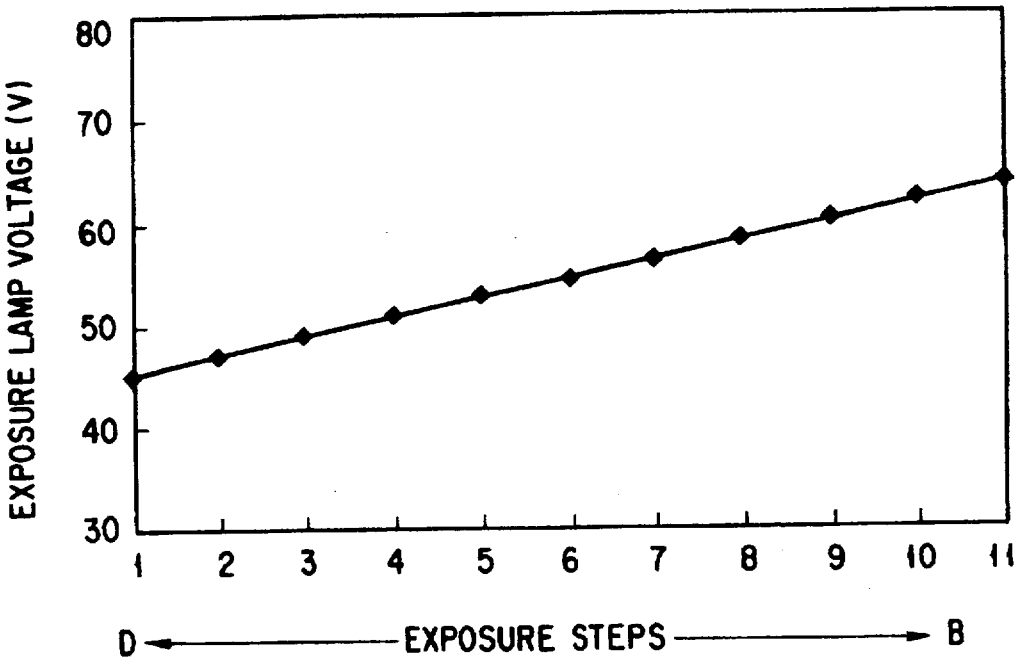
FIG. 1 PRIOR ART
FIG. 1 is a graph showing a relation of an exposure lamp application voltage to an exposure step for explaining the conventional technique.
Figure 2:
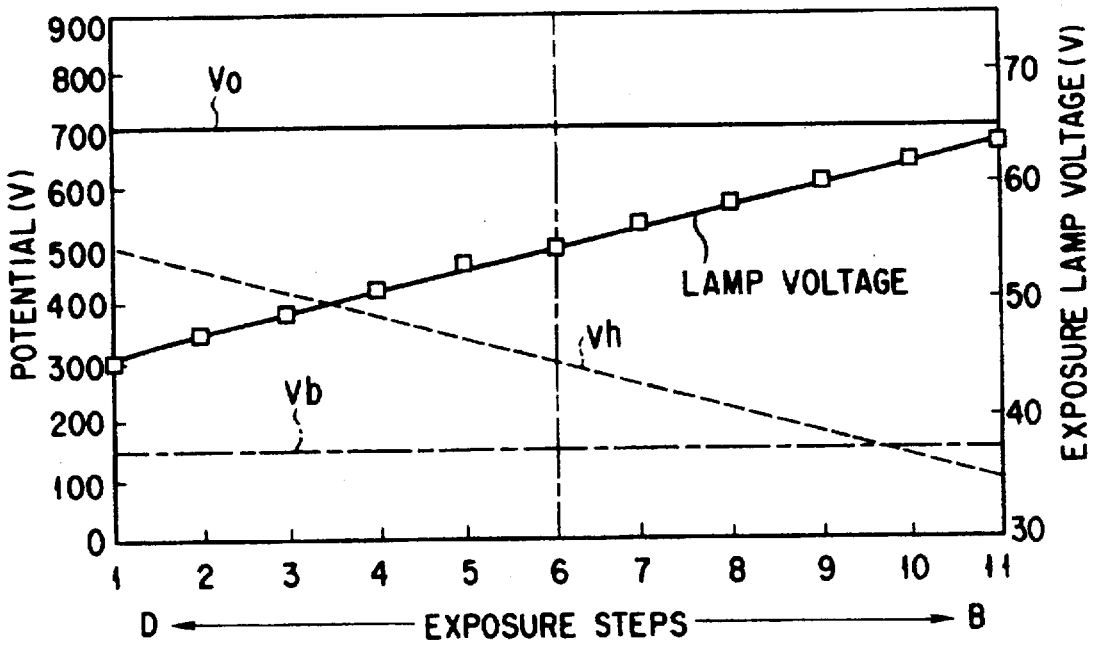
FIG. 2 PRIOR ART
FIG. 2 is a graph showing a relation among a surface potential, half tone potential, developing bias voltage and exposure lamp application voltage relative to an ordinary exposure step axis for explaining the conventional technique.

Here, comparison study was made among a predictive value (solid line) of an image density variation in the case where control is made (control in FIG. 1) on the prediction that the exposure lamp application voltage can be raised through the usual exposure step adjustment, an image density variation (dotted line) in the case of the control (control by the surface potential in FIG. 3) of the bright side through the normal exposure step adjustment and an image density variation (dash dot line) in the case of the control (control in FIG. 7) of the bright side through the exposure step adjustment of the present embodiment. In this connection it is to be noted that an image was printed with an ID patch of, for example, a given density (1.0) and a resultant image density was measured by the Macbeth densitometer.

As evident from FIG. 8, in comparison with the case of the control of the bright side of the ordinary exposure step axis, a better image was obtained, even at the bright max. (11-th step) position of the exposure steps, with the printed image density of over 1.0, a result which has been found effective in accordance with the present embodiment. The reason that, in this way, the printed image density is largely increased with a smaller lamp voltage control amount and surface potential control in comparison with the conventional control is because in a 0.8 to 1.3 range the density is largely varied by, or largely sensitive to, the lamp voltage variation and surface potential variation.

Figure 9:
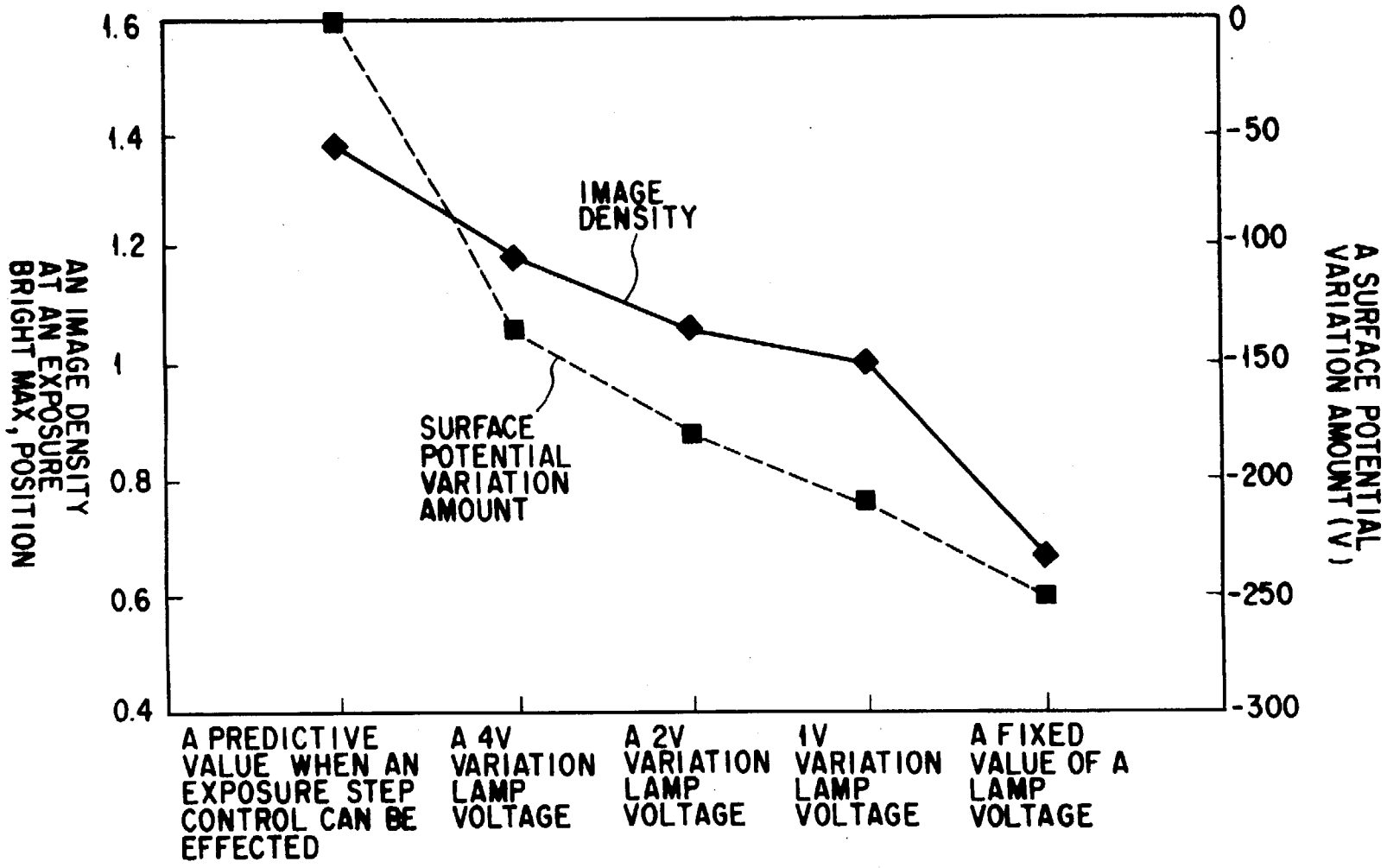
FIG. 9 is a graph showing a relation of an image density to the kinds of exposure control and bright max. position of an exposure step axis.

Although in the control in FIG. 7, the exposure lamp application voltage has been explained as being varied, with a given slope, from the middle position to the bright max. position of the exposure step axis, FIG. 9 shows a result of study on the variation of the image density relative to the exposure steps when an exposure lamp application voltage varies in amount. Here, the Leodry model 6550 was used as the electronic copying apparatus for study. Further, an image was taken in an ordinary temperature/ordinary humidity environment with the use of D-6550 as a developing agent, T-6550 as a toner and SD-6550 (selenium arsenide drum) as the photosensitive drum. The study was made thereon for comparison.

The slope of a variation of the exposure lamp application voltage was controlled based on the stored data in the ROM and images were taken in the case of the usual exposure step control (no control on the bright side of the exposure steps) and a 4 V, 2V, 1V and 0V variation of the exposure lamp application voltage in which case the lamp exposure application voltage was fixed from the middle position to the bright max. position of the exposure step axis. And comparison was made on the bright max. position (11-th step) of the exposure step axis. Here, the abscissa represents the kinds of exposure control and the ordinate (left), the image density at the bright max. position of the exposure step axis and the ordinate (right), the surface potential variation amount.

As evident from FIG. 9, in comparison with the case of setting the exposure lamp application voltage to a given level (the control on the bright side of the ordinary exposure step) the surface potential on the photosensitive drum 1 suffered less variation and a better image was obtained with the printed image density of over 1.0, a result which has been found of advantage.

Figure 10:
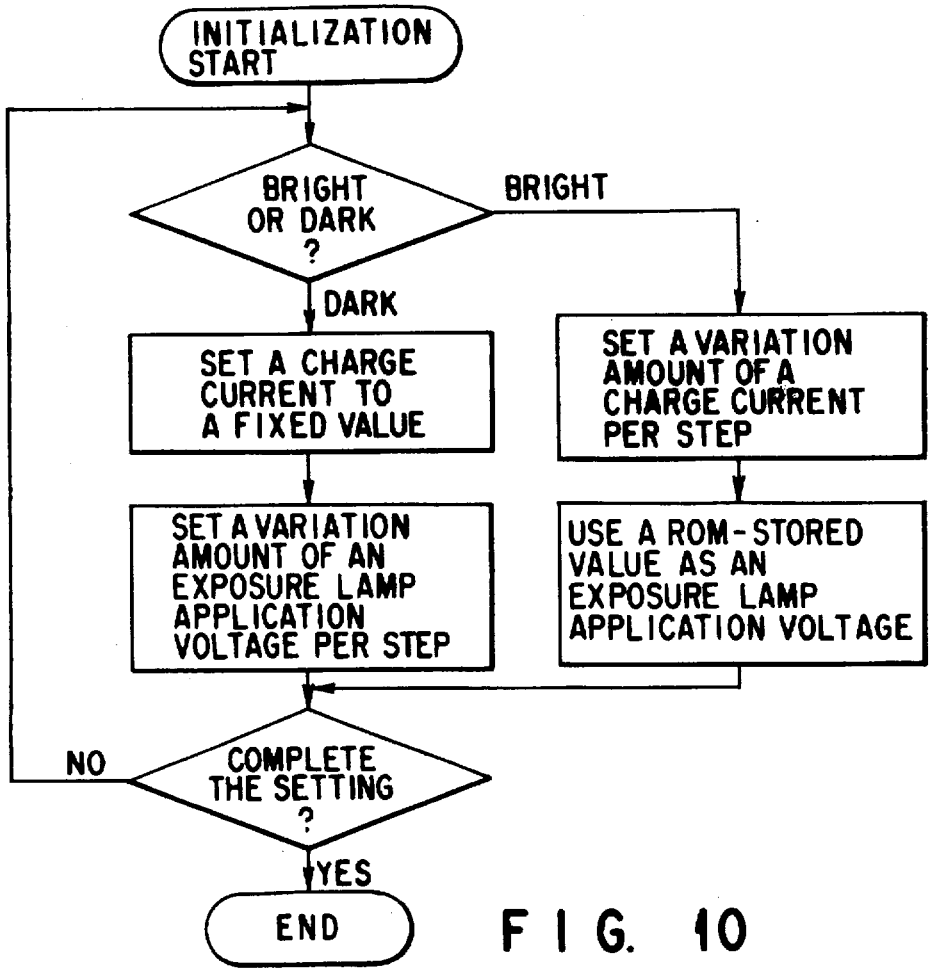
FIG. 10 shows a flow chart for explaining an initialization adjustment.
Figure 11:
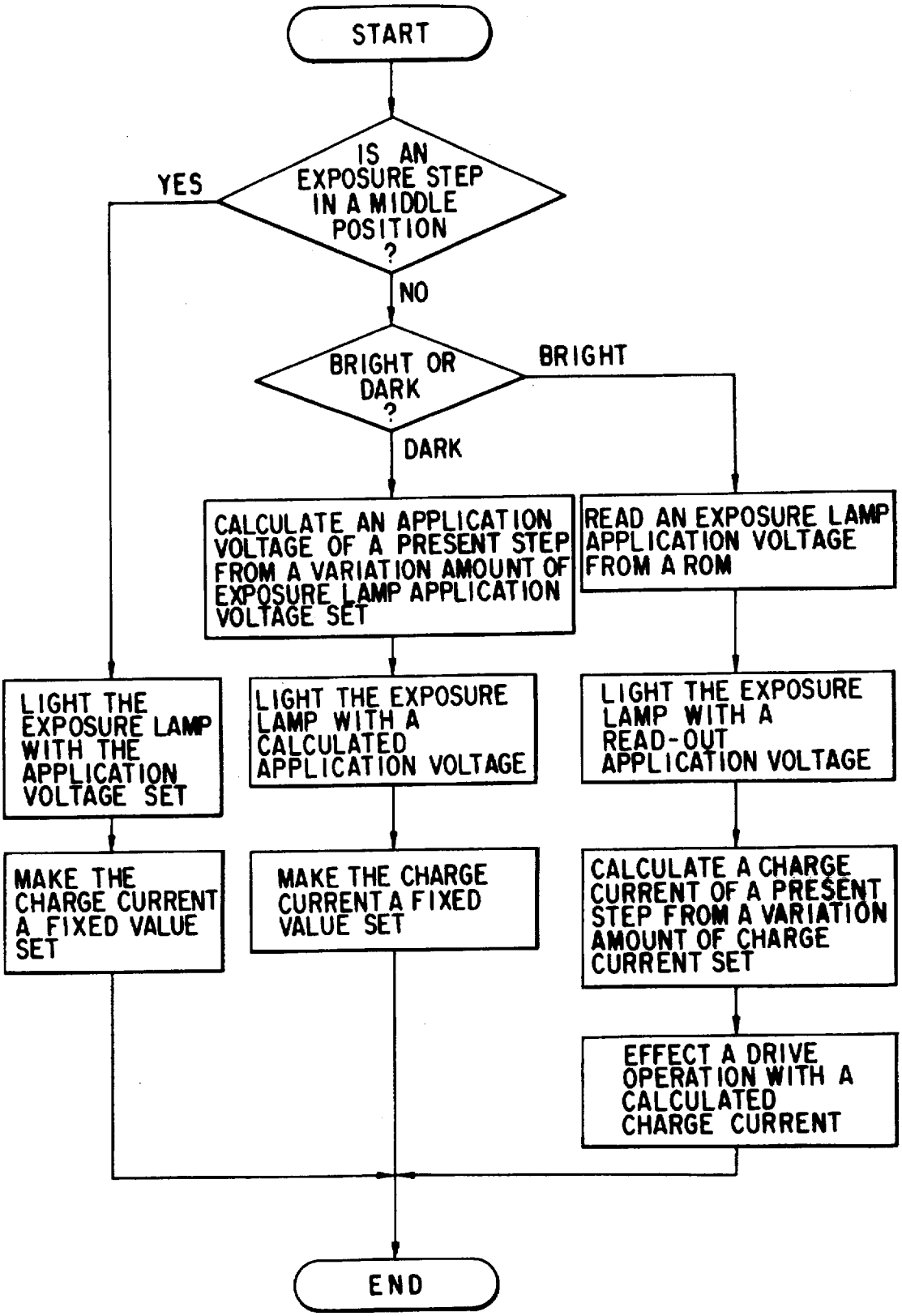
FIG. 11 shows a flow chart for explaining actual control operation.
Figure 12:
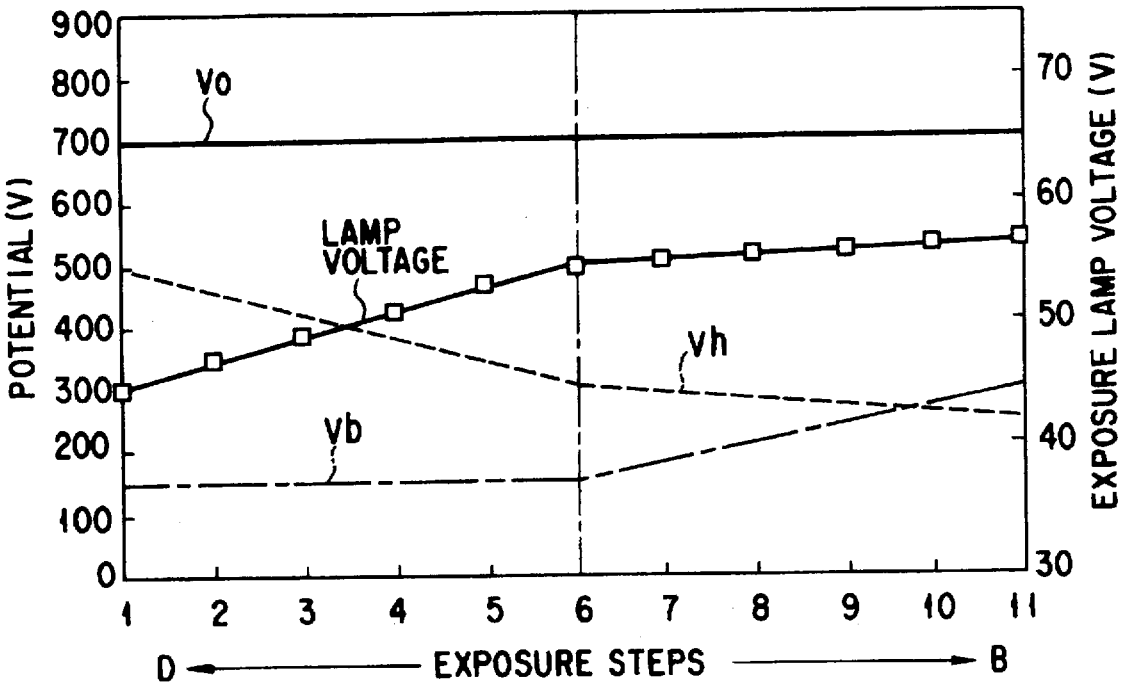
FIG. 12 is a graph showing a relation among a surface potential, half tone potential, developing bias voltage and exposure lamp application voltage to an exposure step axis in another embodiment of the present invention.

On the above-mentioned control an explanation will be given in more detail below with reference to flow charts in FIGS. 10 and 11.

First an explanation will be given below on the initialization by referring to the flow chart of FIG. 10. First, the exposure step input unit 25 is set to a dark side (steps 1 to 6)—step ST1 and control sets a variation amount of a charge current per exposure step. In this case, as shown in FIG. 7, a variation amount (that is, an output variation amount of the high tension generation unit 19) is set by the charge current adjusting unit 28 to allow the surface potential (V0) on the photosensitive drum 1 to be set to the same amount at each exposure step—step ST2. Further, control sets the variation amount of the exposure lamp application voltage per each exposure step. In this case, as shown in the graph in FIG. 7, the variation amount of the exposure lamp application voltage is set so as to vary (increase) the application voltage of the exposure lamp 10 at each exposure step—step ST3.

Then the exposure step input unit 25 is set to the bright side (6 to 11 steps) and the variation amount of the charge current per exposure step is set by the charge current adjusting unit 28. In this case, as shown in FIG. 7, the variation amount of the charge current of the charger 2 is set so as to vary (decrease) the surface potential (V0) on the photosensitive drum 1 at each exposure step—step ST5. Further, the variation amount of the exposure lamp application voltage per exposure step is set. In this case use is made of the application voltage data per exposure step initially stored in the ROM 26—step ST6. The ROM 26 initially stores application voltage data at each exposure step so as to vary (increase) the application voltage of the exposure lamp 10 at each exposure step.

Then actual control will be explained with reference to the flow chart in FIG. 11. Checking is made to see whether or not the exposure step of the exposure step input unit 25 is situated in the middle position (sixth step)—step ST11. If YES, the exposure lamp is lighted with an application voltage—step ST12 and an initially set fixed value is used as the charge current—step ST13. If NO, checking is made to see whether the exposure step is situated on the dark side or on the bright side—step ST14. If, as a result of checking, the exposure step input unit 25 is set to the dark side, the exposure lamp application voltage of the exposure step involved is calculated from the variation amount of the exposure lamp application voltage initially set and the exposure lamp 10 is lighted by the calculated application voltage—step ST15. The charger 2 is driven via the high tension generation unit 19 to allow the flow of the charge current (the predetermined surface potential V0) of a fixed value initially set—step ST17.

If, as the result of checking (step ST14), the exposure step input unit 25 is set to the bright side, the application voltage data corresponding to the exposure step is read from the ROM 26—step ST18 and the exposure lamp 10 is lighted in accordance with the application voltage data—step ST19. The charge current of the exposure step is calculated from the variation amount of the charge current initially set—step ST20—and the charger 2 is driven via the high tension generation section 19 so as to allow the flow of the calculated charge current—step ST21.

According to the present invention, even on the bright side of the exposure step in the adjustment of the exposure amount, the application voltage of the exposure lamp is varied (increased) with a predetermined slope without making the exposure lamp fixed as in the conventional case. A shortage of an exposure is replenished by the control of lowering the surface potential on the photosensitive drum. This produces a lowering in density of the image and neither deposition of carriers nor other drawbacks and a better image is obtained at all times even at any exposure step. It is, therefore, possible to prevent a rise in temperature of the document table, and an increase in a load on the power source voltage, caused by a rise in the exposure lamp application voltage on the bright side of the exposure step.

Figure 4:
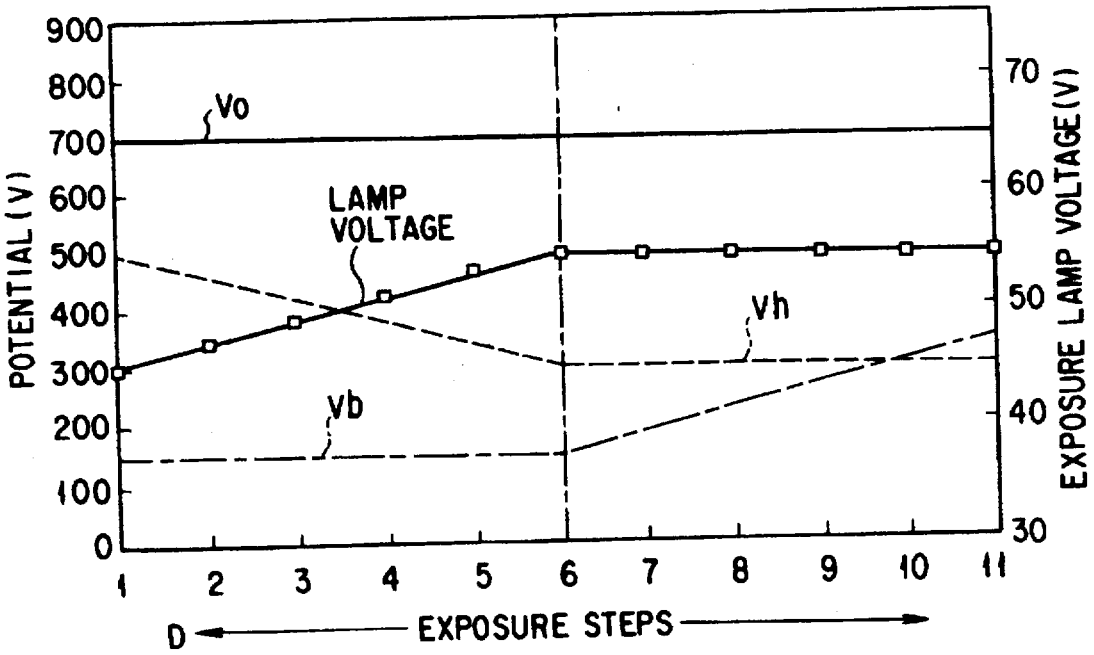
FIG. 4 PRIOR ART
FIG. 4 is a graph showing a relation among a surface potential, half tone potential, developing bias voltage and exposure lamp application voltage relative to an exposure step axis for explaining the conventional technique in the case where a developing bias voltage is controlled.
Figure 5:
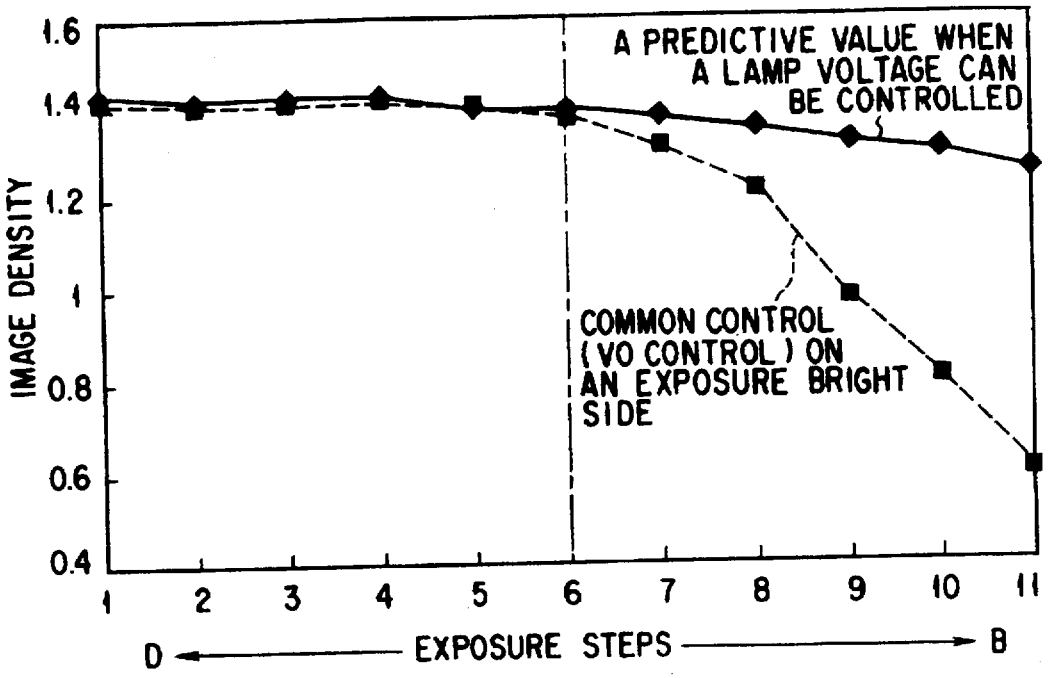
FIG. 5 PRIOR ART
FIG. 5 is a graph showing a relation of an image density to an exposure step axis for explaining the conventional technique.

In the above-mentioned embodiment, exposure amount varying control is carried out by varying (increasing) the application voltage of the exposure lamp 10 with the predetermined slope on the bright side of the exposure step axis and varying (decreasing) the surface potential of the photosensitive drum 1. It is also possible to obtain the same advantage as set out above in conjunction with the above-mentioned embodiment even if the developing bias voltage applied to the developing unit 4 is varied (increased) as shown in FIG. 4. The same thing can also be said even in the case where both the surface potential of the photosensitive drum 1 and the developing bias voltage are controlled in a variable way.

Figure 13:
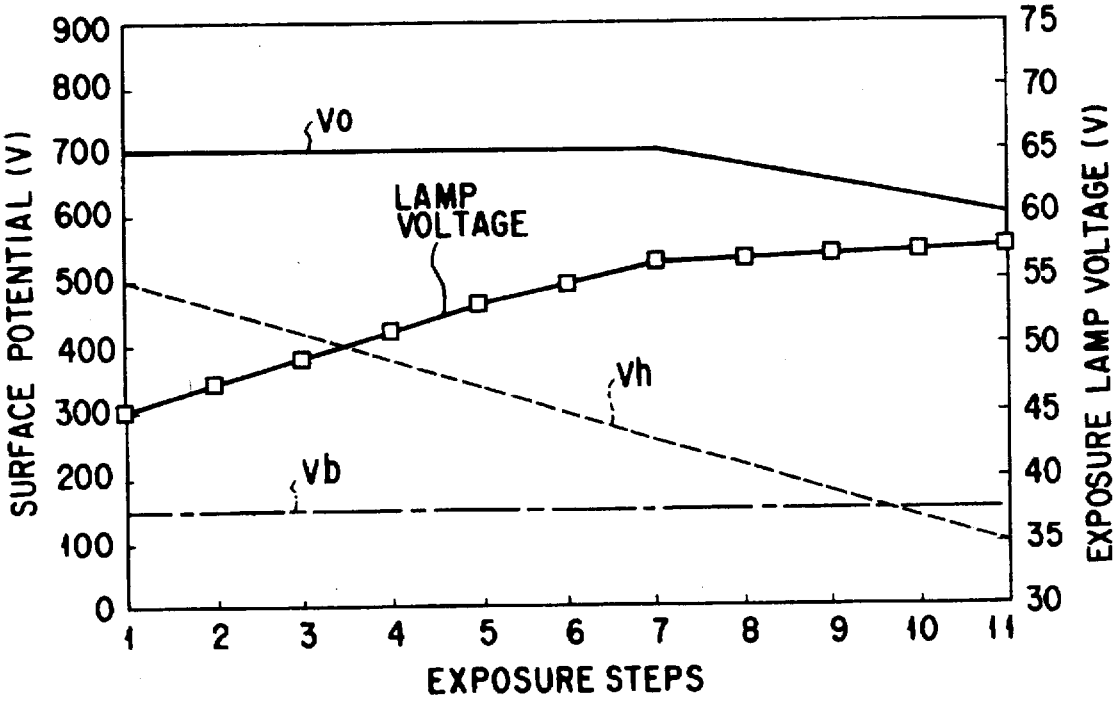
FIG. 13 is a graph showing a relation of a surface potential, half tone potential, developing bias voltage and exposure lamp application voltage to an exposure step axis in another embodiment of the present embodiment.

Although, in the above-mentioned embodiment, control is made from the middle position toward the bright max. position, the control starting exposure step is not restricted to the middle position of the exposure step axis. Further, control can be effected from any exposure step position except at the bright max. position and dark max. (the darkest exposure step, that is, the first step) position. For example, if control is made from the brighter exposure step position than from the middle position of the exposure step axis, it is possible to obtain the same advantage as in the above-mentioned embodiment. The same thing can also be true even if control is made from a darker exposure step than from the middle position of the exposure step axis. FIG. 13 shows the case where control is effected from a 7-th step position, that is, from a one step brighter position from the middle position of the exposure step axis.

Further, a variation amount from a control start step of the exposure lamp application voltage to a control end step may be in any level except a 0V. Put it in more detail, the variation amount can be properly selected on the bright side of the exposure steps depending upon a desired image density or the deposition or no deposition of carriers.

Although, regarding the tilt of the exposure lamp application voltage, the exposure lamp application voltage has been explained as being varied, with a predetermined slope, between one exposure step position and the bright max. position in the present embodiment, it is also possible to vary the slope of the exposure lamp application voltage on its partway. Further, the same effect as set out above can also be obtained by curvilinearly varying the exposure lamp application voltage.

According to the present invention, as set out in more detail, an image forming apparatus is provided which can obtain a better image at all times by preventing a lowering in density of an image, as well as the deposition of carriers and other disadvantages, even on the bright side of the exposure steps in the adjustment of the exposure amount.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

charging means for charging a surface of a photosensitive body;

first supplying means for supplying a first voltage to the charging means, the charging means changing an amount of the charge in accordance with the first voltage supplied to the charging means;

exposing means for exposing an original with light to form an electrostatic latent image on the surface of the photosensitive body charged by the charging means;

second supplying means for supplying a second voltage to the exposing means, the exposing means changing an amount of light in accordance with the second voltage supplied to the exposing means;

developing means for developing the electrostatic latent image on the photosensitive body;

setting means for setting an image density of the image formed by the developing means in accordance with a selected step of a plurality of image density steps;

first control means for reducing the second voltage by a first amount each time the selected image density step designates a darker image and for maintaining the first voltage constant when the selected image density step designates a darker image than that of the middle of the plurality of image density steps; and second control means for increasing the second voltage by a second amount smaller than the first amount each time the selected image density step designates a brighter image and for changing the first voltage in accordance with the second voltage when the selected image density step designates a brighter image than that of the middle of the plurality of image density steps.

2. An image forming apparatus according to claim 1, wherein the second control means reduces the first voltage in accordance with the second voltage.

3. An image forming apparatus according to claim 1, further comprising:

means for supplying a third voltage to the developing means; and means for changing the third voltage in accordance with the selected image density step.

4. An image forming apparatus comprising:

a photosensitive body rotatable in a predetermined direction;

charging means for charging a surface of the photosensitive body, the charging means adjusting an amount of charge on the surface of the photosensitive body by controlling a charge current;

an exposure lamp for illuminating a document;

exposing means for adjusting an amount of light on the surface of the photosensitive body by controlling an application voltage of the exposure lamp;

optical means for imaging an optical image of the document which is illuminated with the exposure lamp on the surface of the photosensitive body to provide an electrostatic latent image;

developing means for depositing, with a developing agent, the electrostatic latent image formed by the optical means on the surface of the photosensitive body to provide a developed image;

transferring means for transferring the developed image on the surface of the photosensitive body to a sheet;

exposure step input means for inputting a desired brightness level of a printing image as one of a plurality of input exposure steps; and control means including first control means for controlling the exposing means such that, when the input exposure step is a darker step than a predetermined step, a voltage which varies at a predetermined rate in accordance with the input exposure step is applied to the exposure lamp, and second control means for controlling the exposing means such that, when the input exposure step is a brighter step than the predetermined step, a voltage which varies at a smaller rate than the predetermined rate in accordance with the input exposure step is applied to the exposure lamp and for controlling the charging means such that the charging current which varies at a predetermined rate in accordance with the input exposure step flows through the charging means;

the predetermined step being a middle step of the plurality of input exposure steps.

5. An image forming apparatus comprising:

a photosensitive body rotatable in a predetermined direction;

charging means for charging a surface of the photosensitive body, the charging means adjusting an amount of charge on the surface of the photosensitive body by controlling a charge current;

an exposure lamp for illuminating a document;

exposing means for adjusting an amount of light on the surface of the photosensitive body by controlling an application voltage of the exposure lamp;

optical means for imaging an optical image of the document which is illuminated with the exposure lamp on the surface of the photosensitive body to provide an electrostatic latent image;

developing means for depositing, with a developing agent, the electrostatic latent image formed by the optical means on the surface of the photosensitive body to provide a developed image;

transferring means for transferring the developed image on the surface of the photosensitive body to a sheet;

exposure step input means for inputting a desired brightness level of a printing image as one of a plurality of input exposure steps; and control means including first control means for controlling the exposing means such that, when the input exposure step is a darker step than a predetermined step, a voltage which varies at a predetermined rate in accordance with the input exposure step is applied to the exposure lamp, and second control means for controlling the exposing means such that, when the input exposure step is a brighter step than the predetermined step, a voltage which varies at a smaller rate than the predetermined rate in accordance with the input exposure step is applied to the exposure lamp and for controlling the charging means such that the charging current which varies at a predetermined rate in accordance with the input exposure step flows through the charging means;

the predetermined step being a brighter step than a middle one of the plurality of input exposure steps.

* * * * *